US005976354A

United States Patent [19]

Powers et al.

[11] Patent Number: 5,976,354

[45] Date of Patent: Nov. 2, 1999

[54] INTEGRATED LUBE OIL HYDROREFINING PROCESS

[75] Inventors: John Robert Powers, Port Neches; Robert M Steinberg, Sugar Land, both of Tex.

[73] Assignee: Shell Oil Company, Houston, Tex.

[21] Appl. No.: 08/914,458

[22] Filed: Aug. 19, 1997

[51] Int. Cl.[6] ..... C10G 25/00

[52] U.S. Cl. ..... 208/89; 208/81; 208/212; 208/82; 208/83; 208/93

[58] Field of Search ..... 208/81, 89, 212, 208/82, 83, 93

[56] References Cited

U.S. PATENT DOCUMENTS

| | | | |
|---|---|---|---|
| 3,637,485 | 1/1972 | Salka | 208/211 |
| 5,258,117 | 11/1993 | Kolstad | 208/309 |

*Primary Examiner*—Helane Myers
*Attorney, Agent, or Firm*—Kim Muller

[57] ABSTRACT

In an integrated lube oil process, a lube oil stock is hydrotreated over a non-noble metal containing hydrotreating catalyst in an HDN/HDS unit to remove sulfur and nitrogen from the lube oil stock and produce an HDN/HDS unit effluent. The effluent comprises hydrodesulfurized, hydrodenitrogenated lube oil stock, hydrogen sulfide and ammonia. The hydrogen sulfide and ammonia are stripped from the hydrodesulfurized, hydrodenitrogenated lube oil stock to form a liquid stream comprising stripped lube oil stock and a first gas stream comprising hydrogen sulfide, ammonia and molecular hydrogen. The stripped lube oil stock is hydrotreated over a noble-metal containing hydrotreating catalyst in an HDW unit to produce an HDW unit effluent comprising a dewaxed lube oil stock. A second gas stream comprising molecular hydrogen is separated from the dewaxed lube oil stock. The first gas stream is combined with the second gas stream to form a third gas stream. The third gas stream is treated to remove ammonia and hydrogen sulfide and form a fourth gas stream comprising primarily molecular hydrogen. The fourth gas stream is compressed to form a fifth gas stream. At least a portion of the fifth gas stream is mixed with the lube oil stock.

11 Claims, 2 Drawing Sheets

INTEGRATED LUBE OIL HYDROREFINING PROCESS

BACKGROUND OF THE INVENTION

The invention relates to hydrotreating and aromatics saturation of lube oil stocks.

Lube base oils are normally manufactured by making narrow cuts of vacuum gas oils from a crude vacuum tower. The cut points are set to control the final viscosity and flash point of the lube base oil. The vacuum gas oils (or waxy distillates) are refined by either the traditional solvent refining process or a high pressure hydrocracker to remove aromatics and improve the viscosity index (V.I.). The refined waxy distillates are either hydrotreated to improve color and solvent dewaxed to reduce the pour point or catalytically dewaxed in a hydroprocessor containing both dewaxing and hydrotreating catalysts.

Lube base oils are traditionally catalytically dewaxed by a zeolyst catalyst that selectively cracks straight chain paraffins (which tend to have high pour points) to light hydrocarbons such as propane. More recently, catalysts have been developed that, in addition to their selective cracking function, isomerize (or selectively dewax) the straight chain paraffins to branched paraffins which, due to their low pour point and high V.I., are ideal lube base oils. Isomerizing instead of cracking the waxy molecules not only produces a greater yield of lube base oils but also produces base oils with a higher V.I.

These newer catalysts contain noble metals such as platinum. They were developed for use on hydrocracked feed stocks which contain very low levels of nitrogen and sulfur. Even small quantities of $H_2S$, $NH_3$, organic sulfur or organic nitrogen can poison these catalysts. It is possible to use these catalysts to dewax solvent refined waxy distillates, but the distillates need to be hydrotreated first to remove sulfur and nitrogen.

In all commercial refinery processes which combine this initial hydrotreating cleanup step with a subsequent hydroprocessing step utilizing a sensitive noble metal catalyst, the process is designed, constructed and operated as essentially two separate units. As a result these processes, an example of which is catalytic reforming of naphtha for production of high octane gasoline, are expensive to construct. Typically, the initial hydrotreating section has a recycle compressor with auxiliaries and charge heater separate from the subsequent noble metal based process. In addition, the hydrotreated material from the initial step is lowered to near atmospheric pressure for stripping to remove $H_2S$ and $NH_3$ prior to being pumped back up to the second stage hydroprocessing pressure. This requires duplicate high pressure pumps and a low pressure stripper tower and auxiliaries.

An integrated process which avoids duplication of equipment would be very desirable.

OBJECTS OF THE INVENTION

This invention concerns integration of the hydrotreating, selective dewaxing, and final aromatic saturation of refined waxy distillates in a single unit in a manner which avoids the replication of expensive process units.

SUMMARY OF THE INVENTION

In accordance with one embodiment of the invention, an apparatus comprises a first reactor means for hydrotreating a liquid hydrocarbon and a second reactor means for hydrodewaxing a liquid hydrocarbon. A source of liquid hydrocarbon is connected to the first reactor means by a first conduit means which forms a fluid flow path between the source and reactor means. A second conduit means form a fluid flow path between the first reactor means and the second reactor means. A source of molecular hydrogen is connected to the first conduit means by a third conduit means which forms a fluid flow path between the source of molecular hydrogen and the first conduit means and to the second conduit means by a fourth conduit means which forms a fluid flow path between the source of molecular hydrogen and the second conduit means. Hydrocarbon liquid is withdrawn from the second reactor means by a fifth conduit means.

Splitting the hydrogen into multiple streams permits use of a single recycle hydrogen compressor for the initial hydrotreating cleanup stage(s) and the subsequent noble metal catalyst hydroprocessing stage(s).

In the process of one embodiment of the invention, a lube oil stock is hydrotreated over a non-noble metal containing hydrotreating catalyst in an HDN/HDS unit to remove sulfur and nitrogen from the lube oil stock and produce an HDN/HDS unit effluent. The effluent comprises hydrodesulfurized, hydrodenitrogenated lube oil stock, hydrogen sulfide and ammonia. The hydrogen sulfide and ammonia are stripped from the hydrodesulfurized, hydrodenitrogenated lube oil stock to form a liquid stream comprising stripped lube oil stock and a first gas stream comprising hydrogen sulfide, ammonia and molecular hydrogen. The stripped lube oil stock is hydrodewaxed over a noble-metal containing dewaxing catalyst in an HDW unit to produce an HDW unit effluent comprising a dewaxed lube oil stock. A second gas stream comprising molecular hydrogen is separated from the dewaxed lube oil stock. If desired, a noble metal containing stabilization or aromatic saturation catalyst can be employed in a third stage or third unit following the HDW unit. In this case, the second gas stream comprising molecular hydrogen can be separated from the dewaxed, stabilized lube oil stock. The first gas stream is combined with the second gas stream to form a third gas stream. The third gas stream is treated to remove ammonia and hydrogen sulfide and form a fourth gas stream comprising primarily molecular hydrogen. The fourth gas stream is compressed to form a fifth gas stream At least a portion of the fifth gas stream is mixed with the lube oil stock.

Combining the gas streams permits the use of a single clean-up unit for the multiple hydrotreaters.

DETAILED DESCRIPTION OF THE INVENTION

Figure 1:
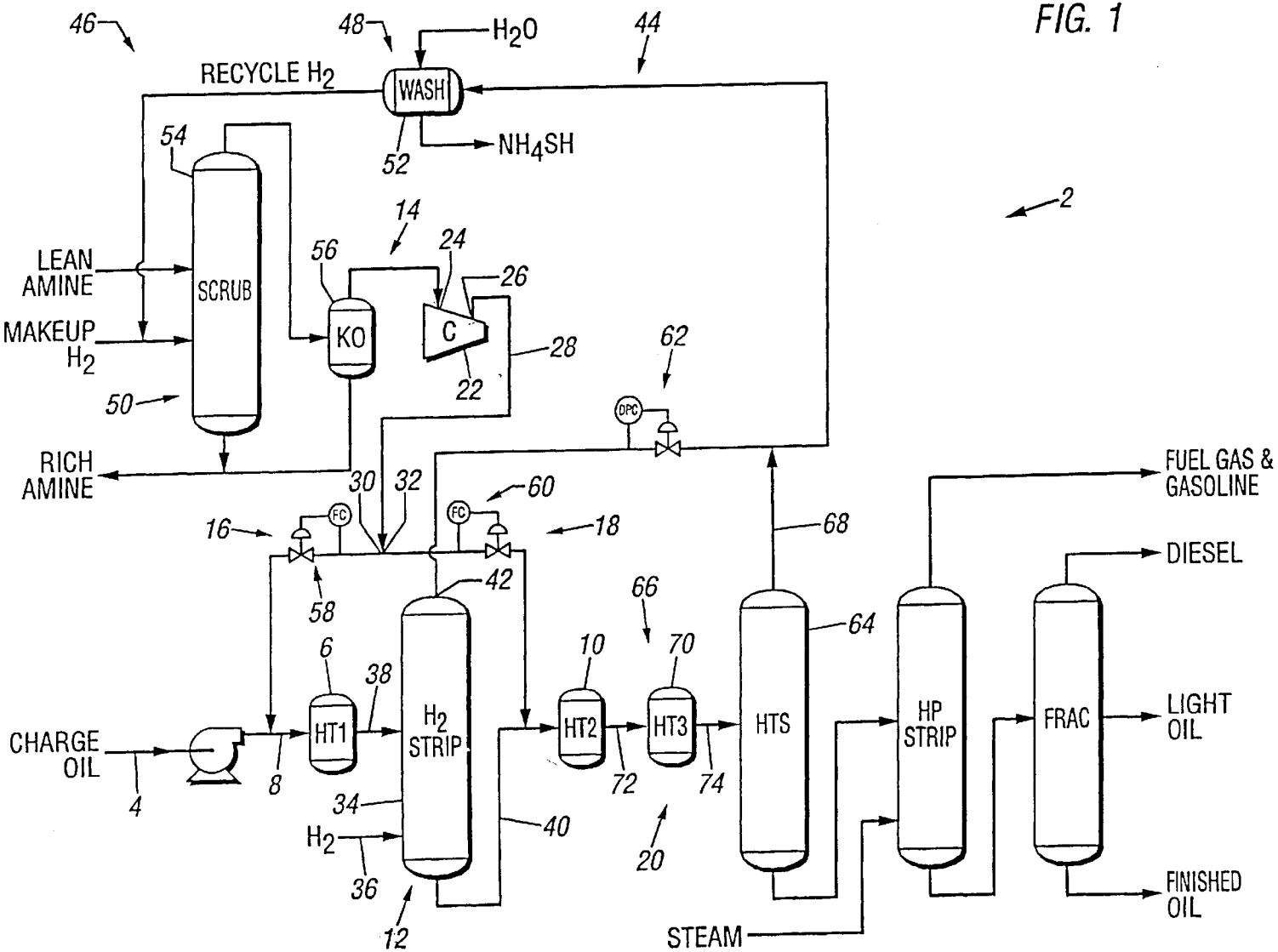
FIG. 1 schematically illustrates a reactor train embodying certain features of the invention primarily relating to hydrogen circulation.

A primary utility of the present invention is believed to be in the preparation of a lube base stock for multi grade (e.g., 5W-30) engine oil applications from a stream of a lube boiling range distillate, such as one prepared by solvent extraction of a suitable stock, by hydrotreating, (preferably under low severity conditions), stripping for hydrogen sulfide and ammonia removal, catalytic dewaxing, and optionally aromatics saturation and base oil stability improvement using an aromatics saturation catalyst.

In the Figures, HT1 denotes a mild hydrotreating process unit, HT2 denotes a catalytic dewaxing unit, and HT3 denotes the optional aromatics saturation unit.

The HT1 Unit

A suitable feed for the HT1 unit can be prepared by a solvent extractor, not shown. In solvent extraction, a crude oil derived stream having an initial boiling point generally in the range of from about 500° F. to about 650° F. and a 95% boiling point generally in the range of 800° F. to 950° F. is extracted with a known solvent. Suitable solvents are well known, as are process conditions. Common suitable solvents include N-methyl-pyrrolidone, furfural, phenol and sulfur dioxide. The raffinate from the extraction forms the feed for HT1 unit.

The HT1 unit is generally operated to remove nitrogen and sulfur from the HT1 charge stock. This process is referred to as hydrodesulfurization/hydrodenitrogenation, HDS/HDN. Generally speaking, the HDS/HDN is conducted at a temperature in the range of from about 575° F. to about 780° F. Usually, the temperature will be in the range of from about 600° F. to about 760° F. Preferably, the temperature will be in the range of about 625° F. to about 730° F. Hydrogen will generally be present at a hydrogen partial pressure in the range of from about 150 psig to about 3500 psig, and total pressure will generally be in the range of from about 200 psig to about 4,000 psig. Usually, hydrogen partial pressure will be in the range of from about 350 psig to about 1400 psig and a total pressure will be in the range of from about 400 psig to about 1500 psig.

Generally, in the range of from about 1,000 scf to about 10,000 scf of hydrogen are contacted with the HDS/HDN catalyst with each barrel of the HDS/HDN feed. Usually, from about 3,000 scf to about 8,000 scf of hydrogen are contacted with the HDS/HDN catalyst with each barrel of the HDS/HDN feed. Severity of contact can vary over a wide range, depending on the degree of heteroatom removal sought. Generally, the HDS/HDN is conducted at an LHSV in the range of from about 0.25 $v_o/Hr/v_c$ to about 2.5 $v_o/Hr/v_c$. Usually, an LHSV in the range of 0.75 $v_o/Hr/v_c$ to about 1.5 $v_o/Hr/v_c$, is employed.

A catalyst having HDS/HDN activity under these conditions is placed in the unit. Generally, a non-noble-metal-containing HDS/HDN catalyst is used. Suitable HDS/HDN catalysts generally comprise alumina or silica alumina and carry Group VIII and/or Group VIB metals as the catalytically active agent. Most preferably, the catalytically active HDS/HDN agent is selected from the group consisting of nickel/molybdenum, cobalt/molybdenum and nickel/tungsten.

A finished catalyst for utilization in the HDS/HDN zone preferably has a surface area of about 200 to 700 square meters per gram, a pore diameter of about 20 to about 300 Angstroms, a pore volume of about 0.10 to about 0.80 milliliters per gram, and apparent bulk density within the range of from about 0.50 to about 1.00 gram/cc. Surface areas above 250 $m^2$/gm are greatly preferred.

An alumina component suitable for use as a support for the HDS/HDN catalyst may be produced from any of the various hydrous aluminum oxides or alumina gels such as alpha-alumina monohydrate of the boehmite structure, alpha-alumina trihydrate of the gibbsite structure, beta-alumina trihydrate of the bayerite structure, and the like. A particularly preferred alumina is referred to as Ziegler alumina. A preferred alumina is presently available from the Conoco Chemical Division of Continental Oil Company under the trademark "Catapal". The material is an extremely high purity alpha-alumina monohydrate (boehmite) which, after calcination at a high temperature, has been shown to yield a high purity gamma-alumina.

A silica-alumina component may be produced by any of the numerous techniques which are well defined in the prior art relating thereto. Such techniques include the acid-treating of a natural clay or sand, co-precipitation or successive precipitation from hydrosols. These techniques are frequently coupled with one or more activating treatments including hot oil aging, steaming, drying, oxidizing, reducing, calcining, etc. The pore structure of the support or carrier, commonly defined in terms of surface area, pore diameter and pore volume, may be developed to specified limits by any suitable means including aging a hydrosol and/or hydrogel under controlled acidic or basic conditions at ambient or elevated temperature, or by gelling the carrier at a critical Ph or by treating the carrier with various inorganic or organic reagents.

The precise physical characteristics of the catalysts such as size, shape and surface area are not considered to be a limiting factor in the utilization of the present invention. The catalyst particles may be prepared by any known method in the art including the well-known oil drop and extrusion methods. The catalysts may, for example, exist in the form of pills, pellets, granules, broken fragments, spheres, or various special shapes such as trilobal extrudates, disposed as a fixed bed within a reaction zone. Alternatively, the catalysts may be prepared in a suitable form for use in moving bed reaction zones in which the hydrocarbon charge stock and catalyst are passed either in countercurrent flow or in co-current flow. Another alternative is the use of fluidized or ebullated bed reactors in which the charge stock is passed upward through a turbulent bed of finely divided catalyst, or a suspension-type reaction zone, in which the catalyst is slurried in the charge stock and the resulting mixture is conveyed into the reaction zone. The charge stock may be passed through the reactors in either upward or downward flow.

Although the hydrogenation components may be added to the HDS/HDN catalyst before or during the forming of the support, the hydrogenation components are preferably composited with the catalysts by impregnation after the selected inorganic oxide support materials have been formed, dried and calcined. Impregnation of the metal hydrogenation component into the particles may be carried out in any manner known in the art including evaporative, dip and vacuum impregnation techniques. In general, the dried and calcined particles are contacted with one or more solutions which contain the desired hydrogenation components in dissolved form. After a suitable contact time, the composite particles are dried and calcined to produce finished catalyst particles.

Hydrogenation components contemplated for the HDS/HDN catalysts are those catalytically active components selected from Group VIB and Group VIII metals and their compounds.

References herein to the Periodic Table are to that form of the table printed adjacent to the inside front cover of Chemical Engineer's Handbook, edited by R. H. Perry, 4th edition, published by McGraw-Hill, copyright 1963. Generally, the amount of hydrogenation components present in the final catalyst composition is small compared to the quantity of the other above-mentioned components combined therewith. The Group VIII component generally comprises about 0.1 to about 30% by weight, preferably about 1 to about 15% by weight of the final catalytic composite calculated on an elemental basis. The Group VIB component comprises about 0.05 to about 30% by weight, preferably about 0.5 to about 15% by weight of the final catalytic composite calculated on an elemental basis. The hydrogenation components contemplated for the HDS/HDN catalyst include one or more metals chosen from the group consisting of molybdenum, tungsten, chromium, iron, cobalt, nickel, platinum, palladium, iridium, osmium, rhodium, ruthenium and mixtures thereof The desuliriation catalyst preferably contains two metals chosen from cobalt, nickel, tungsten and molybdenum.

The hydrogenation components of the HDS/HDN catalyst will most likely be present in the oxide form after calcination in air and may be converted to the sulfide form if desired by contact at elevated temperatures with a reducing atmosphere comprising hydrogen sulfide, a mercaptan or other sulfur containing compound.

It is preferred that the catalyst(s) used in the HDS/HDN zone is essentially free of any noble metal such as platinum or palladium.

The HT2 Unit

The HT2 unit is generally operated to reduce the paraffin content of the HT2 charge stock. This process is referred to as catalytic dewaxing, or hydrodewaxing, HDW. In catalytic dewaxing, the feed is passed over a dewaxing catalyst under dewaxing conditions to form the feed for the next subsequent downstream unit. Generally speaking, suitable dewaxing conditions include a temperature in the range of from about 500° F. to about 800° F. and a pressure in the range of from about 200 to about 5,000 psig.

Two general types of catalytic dewaxing processes are believed to be suitable, cracking and isomerization. These processes are exemplified by the ZSM-5 based catalyst, which relies heavily on a cracking mechanism to dewax the stock, and the SAPO-11 based catalyst or equivalent, which relies heavily on an isomerization mechanism to dewax the stock.

In the first case, the catalytic dewaxing catalyst comprises a zeolite selected from the group consisting of ZSM 5 and ZSM 35 on an alumina support. The catalytic dewaxing is usually conducted at an LHSV in the range of from about 0.5 vol/vol/hr to about 2.5 $v_o/Hr/v_c$. Usually, hydrogen is present at a partial pressure in the range of from about 150 psig to about 3,500 psig, preferably in the range of from about 350 psig to about 1,400 psig. Generally, from about 1,000 scf to about 10,000 scf of hydrogen are contacted with the catalytic dewaxing catalyst with each barrel of the catalytic dewaxer feed. Usually from about 3,000 to about 8,000 scf of hydrogen are contacted with the catalytic dewaxing catalyst with each barrel of the catalytic dewaxer feed.

In the second case, the catalytic dewaxing catalyst comprises a zeolite support having deposited thereon a catalytic agent selected from the group consisting of nickel, nickel/tungsten, platinum and palladium. The catalytic dewaxing is generally conducted at a temperature in the range of from about 400° F. to about 800° F., usually in the range of from about 575° F. to about 750° F., and preferably at a temperature in the range of from about 590° F. to about 750° F. Usually, hydrogen is present at a partial pressure in the range of from about 150 psig to about 3,500 psig, preferably in the range of from about 350 psig to about 1,400 psig. The catalytic dewaxing is generally conducted at an LHSV in the range of from about 0.1 $v_o/Hr/v_c$ to about 10 $v_o/Hr/v_c$, usually in the range of about 0.2 $v_o/Hr/v_c$ to about 8 $v_o/Hr/v_c$, and preferably is conducted at an LHSV in the range of from about 0.5 $v_o/Hr/v_c$ to about 2 $v_o/Hr/v_c$. Generally, from about 1,000 scf to about 10,000 scf of hydrogen are contacted with the catalytic dewaxing catalyst with each barrel of the catalytic dewaxer feed. Usually from about 2,000 to about 5,000 scf of hydrogen are contacted with the catalytic dewaxing catalyst with each barrel of the catalytic dewaxer feed. When the dewaxing catalyst contains noble metals, it is preferred that the catalytic dewaxer feed contain low levels of sulfur and nitrogen.

The preferred zeolite support to be used in the second case comprises a silicoaluminophosphate molecular sieve (SAPO). The preferred SAPO comprises a molecular sieve having a silicoaluminophosphate molecular framework which has an intermediate pore size and which comprises a molecular framework of conersharing $[SiO_2]$ tetrahedra, $[AlO_2]$ tetrahedra, and $[PO_2]$ tetrahedra, [i.e., $(SiAl_yP)O_2$ tetrahedral units], and which functions to convert the feedstock to dewaxed products under the process conditions noted above.

By "intermediate pore size" is meant an effective pore aperture in the range of about 5.3 to 6.5 Angstroms when the molecular sieve is in the calcined form. Molecular sieves having pore apertures in this range tend to have unique molecular sieving characteristics. Unlike small pore zeolites such as erionite and chabazite, they will allow hydrocarbons having some branching into the molecular sieve void spaces. Unlike larger pore zeolites such as the faujasites and mordenites, they can differentiate between n-alkanes and slightly branched alkanes on the one hand and larger branched alkanes having, for example, quaternary carbon atoms.

The silicoaluminophosphates are generally synthesized by hydrothermal crystallization from a reaction mixture comprising reactive sources of silicon, aluminum and phosphorus, and one or more organic templating agents. Optionally, alkali metal(s) may be present in the reaction mixture. The reaction mixture is placed in a sealed pressure vessel, preferably lined with an inert plastic material, such as polytetrafluoroethylene, and heated, preferably under autogenous pressure at a temperature of at least 100° C., and preferably between 100° C. and 250° C., until crystals of the silicoaluminophosphate product are obtained, usually for a period of from 2 hours to 2 weeks. While not essential to the synthesis of SAPO compositions, it has been found that in general stirring or other moderate agitation of the reaction mixture and/or seeding the reaction mixture with seed crystals of either the SAPO to be produced, or a topologically similar composition, facilitates the crystallization procedure. The product is recovered by any convenient method such as centrifugation or filtration.

The reaction mixture from which these SAPOs are formed contain one or more organic templating agents (templates). The template preferably contains one element of Group VA of the Periodic Table, particularly nitrogen, phosphorus, arsenic and/or antimony, more preferably nitrogen or phosphorus and most preferably nitrogen. The template contains at least one alky, aryl, aralkyl, or alkylaryl group. The template preferably contains from 1 to 8 carbon atoms, although more than eight carbon atoms may be present in the template. Nitrogen-containing templates are preferred, including amines and quaternary ammonium compounds, the latter being represented generally by the formula $R'_4N+$ wherein each R' is an alkyl, aryl, alkylaryl, or other aralkyl group; wherein R' preferably contains from 1 to 8 carbon atoms or higher when R' is alkyl and greater than 6 carbon atoms when R' is otherwise, as hereinbefore discussed. Polymeric quaternary ammonium salts such as $[(C_{14}H_{32}N_2)(OH)_2]_x$ wherein "x" has a value of at least 2 may also be employed. The mono-, di- and triamines, including mixed amines, may also be employed as templates either alone or in combination with a quaternary ammonium compound or other template.

The HT3 Unit

The HT3 unit, when employed, is generally operated to produce a low aromatics content product. This process is referred to as Hydrodearomatization, or HDA, or sometimes aromatics saturation, AS, or stabilization. Generally speaking, the aromatics saturation reactor is operated at a temperature in the range of about 350° F. to about 700° F., usually in the range of from about 400° F. to about 600° F. and preferably in the range of from about 450° F. to about 550° F. Good results will be provided at low hydrogen partial pressures, but it is advantageous to operate the aromatics saturation reactor at a pressure only slightly lower than the upstream equipment, to provide for flow. Generally speaking, the hydrogen partial pressure will be in the range of about 150 psig to 3500 psig, usually in the range of from about 300 psig to about 2,500 psig and most preferably in the range of from about 300 psig to about 1,200 psig. Low severity contact between the catalyst and feed will provide good results. Generally, an LHSV in the range of from about 0.1 $v_o/Hr/v_c$ to about 10 will be used, usually in the range of from about 1 $v_o/Hr/v_c$ to about 4 $v_o/Hr/v_c$. The hydrogen rate will usually be in the range of from about 500 scf to about 10,000 scf of hydrogen with each barrel of the aromatics saturation reactor feed. Usually in the range of from about 1,000 scf to about 4,000 scf of hydrogen are contacted with the aromatics saturation catalyst with each barrel of the aromatics saturation reactor feed. Hydrogen purity can vary over a wide range but will generally be 80% pure or higher.

Generally the aromatics saturation catalyst comprises oxides of platinum and palladium supported on an alumina matrix. To provide selectivity for aromatic molecules, the matrix usually contains dispersed zeolite which has a pore size for preferentially reacting aromatic molecules. Generally, only small amounts of platinum and palladium are used. The aromatics saturation catalyst will generally contain in the range of from about 0.1 wt % to about 1 wt % platinum and in the range of from about 0.1 wt % to about 1 wt % palladium, based on elemental weight of metal.

It is believed that the use of a Y-type zeolites in the aromatics saturation catalysts will provide best results, especially Y-type zeolites having relatively low alkali metal contents, say less than 0.3, preferably less than about 0.15 percent by weight basis metal and which have been ion exchanged to increase their alkali(ne earth) metal content. "Y-type zeolites" are zeolites which have the same general crystal structure as zeolite Y but which have contracted unit cells when compared to zeolite Y. These zeolites having contracted unit cells are also known as ultrastable or ultra-stabilized Y zeolites.

The zeolitic materials which can be used as starting materials to form the aromatics saturation catalysts comprise readily available Y-type zeolites such as zeolite Y, ultra-stable zeolite Y and very ultra-stable zeolite Y which have been modified by using processes known in the art to produce the base materials having the required unit cell size dimension together with the required silica to alumina molar ratios and low alkali(ne earth) metal content. Such modification of unit cell size and silica to alumina molar ratio also necessarily produce zeolites having low alkali(ne earth) metal contents. Suitable modification processes comprise ionexchange techniques, say one or more ion-exchange steps with ammonium compounds, followed by one or more calcination stages, optionally in the presence of steam. Normally, Y-type zeolites already partially modified are subjected to a so-called dealumination technique to reduce the amount of alumina present in the system.

The starting zeolite for the production of the aromatics saturation catalyst preferably comprises a Y-type zeolite having a unit cell size less than 24.65 angstroms, a silica to alumina molar ratio of greater than 5 and an alkali(ne earth) metal content of less than 0.3 percent by weight basis metal. Preferably, the unit cell size of the starting zeolite should be less than 24.4 angstroms, preferably less than 24.35 angstroms and more preferably less than 24.30 angstroms. More preferably the unit cell size will range between 24.2 and 24.3 angstroms, and most preferably between 24.22 and 24.28 angstroms. The silica to alumina molar ratio of the preferred zeolite should be greater than 25, more preferably greater than 35, even more preferably greater than 50, and most preferably greater than 60. The processes used to dealuminate zeolites to obtain the high silica to alumina molar ratios of the starting zeolites result in zeolites having alkali(ne earth) metal contents that are relatively low compared to zeolite Y. The alkali(ne earth) metal contents of the preferred starting zeolites are less than 0.15, preferably less than 0.075 and more preferably less than 0.04 percent by weight of the zeolite basis the alkali(ne earth) metal.

The starting zeolites are contacted with one or more solutions, preferably aqueous solutions, comprising one or more alkali(ne earth) metal ions. The contact of the zeolite with the solution of alkali(ne earth) metal ions encompasses ion exchange, impregnation and mixtures thereof The zeolite is contacted with the solution of alkali(ne earth) metal ions under conditions of temperature and times sufficient to cause an increase of alkali(ne earth) metal in the final or processed zeolite of greater than 1.5 times, preferably 2 times, more preferably greater than 5 times the amount of alkali(ne earth) metal originally present in the starting zeolite, when measured as gram equivalent weights of alkali(ne earth) metal per gram of zeolite. For example, if the starting zeolite contained 0.05 percent by weight of sodium oxide, then contact with a sodium ion-containing solution to provide a sodium content greater than 1.5 times would require an increase to greater than 0.075 weight percent sodium oxide, greater than 2 times would require an increase to greater than 0.1 weight percent of sodium oxide, etc. Solution contact temperatures will typically range from 10° C. to 100° C. Times will generally be in excess of 0.1 hours. The processed zeolite will have an alkali(ne earth) metal content ranging from about 0.00004 to about 0.0004 gram equivalent weights of metal per gram of zeolite. In a preferred embodiment wherein the alkali(ne earth) metal is sodium, potassium or mixtures thereof the processed zeolite will have an alkali metal content ranging from 0.1 to 1.4 percent by weight, basis metal, more preferably from 0.1 to 0.8 weight percent, basis metal, for sodium, from 0.2 to 1.4 weight percent, basis metal, for potassium; and 0.1 to 1.4 weight percent, basis metal, for the mixture.

Preferably, the zeolite is admixed with a binder material, such as alumina, silica, silica-alumina aluminophosphates, silicoaluminophosphates, magnesia, titania, clays or zirconia and mixtures thereof, more preferably alumina.

DESCRIPTION OF THE PREFERRED EMBODIMENT

Overview

Hydrotreating the refined waxy distillates to remove the sulfur and nitrogen can be achieved at about the same hydroprocessing conditions (pressure, temperature, space velocity, hydrogen circulation rate) as selective dewaxing. A high degree of aromatic saturation can also be achieved at these same hydroprocessing conditions. This makes it feasible to hydrotreat, dewax and remove the majority of feed aromatics in three sequential reactors in a reactor train forming a process unit. If desired, two or more trains can be incorporated in the same process unit. In either case, the unit will preferably contain only a single recycle compressor and a single process heater.

Most lube oil hydroprocessing units heat up oil and hydrogen in reactor feed/effluent exchangers, combine the oil and hydrogen and route them through a single pass fired heater to the reactor. If the unit has several different catalysts in individual, sequential reactors, typically each individual reactor will have a corresponding heater. This is a sensible arrangement for a typical 2,000–6,000 bpd charge rate with a single reactor train. For a larger unit, a multiple pass fired heater would be required to minimize pressure drop. This would require that either the oil and hydrogen be heated up in separate exchangers (mixed phase hydrogen and oil streams cannot be controlled and distributed evenly) and combined in each pass of the heater through a large number of control valves or else a separate heat exchange train for each heater pass. For a two train unit, this type of complicated heater arrangement would be required for each train.

Many hydrotreaters and hydrocrackers with large hydrogen circulation rates (generally above about 2,500 SCFB) use hydrogen only heaters. Hydrogen only heaters have many advantages over a two-phase heater. The tubes will not coke up. Higher heat fluxes without degrading the oil, or the oil color, are possible. Since they are all vapor phase, control valves are not needed to control the flow to each pass. However, relatively large hydrogen circulation rates are needed to absorb the required heat input without heating the hydrogen to excessive temperatures (above 1000–1050° F.). While lube oil hydroprocessors often have the large hydrogen circulation rates needed for a hydrogen only heater, they have not normally been built that way since their small charge rates permit the use of a simple one pass two phase heater. In hydroprocessing applications which employ a noble metal catalyst after an initial hydrotreating clean up step, for example catalytic reforming of naphtha or white oil manufacture, these units are designed with duplicate recycle compressors and heaters.

An improved heater arrangement that would be applicable to multiple reactors and/or multiple trains with more than 2,500 SCFB hydrogen to each train, particularly one with a high charge rate (above about 6,000 bpd) is described below.

EXEMPLARY EMBODIMENTS

Apparatus

Figure 2:
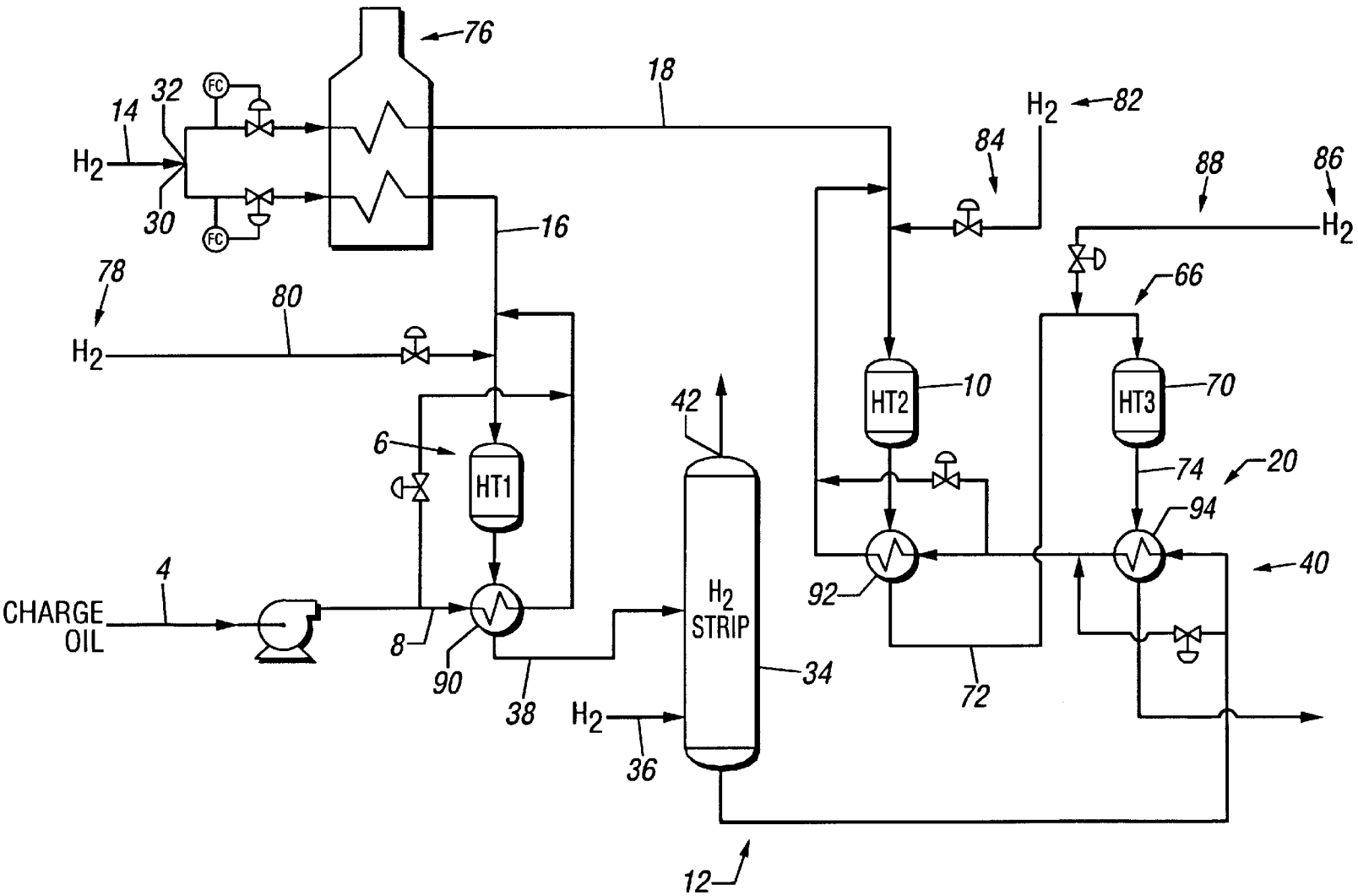
FIG. 2 schematically illustrates a reactor train embodying certain features of the invention primarily relating to energy conservation.

Preferred apparatus for carrying out certain aspects of the invention is shown in FIGS. 1 and 2. The features shown have been designated with like reference numerals where appropriate and can be combined as desired to accomplish varying objectives.

In accordance with one embodiment of the invention, an apparatus 2 comprises a first reactor means 6 for hydrotreating a liquid hydrocarbon and a second reactor means 10 for hydrotreating a liquid hydrocarbon. The reactor means 6 preferably corresponds to the HT1 unit. The reactor means 10 preferably corresponds to the HT2 unit.

A source 4 of liquid hydrocarbon is connected to the first reactor means 6 by a conduit means 8 which forms a fluid flow path between the source and reactor means. A second conduit means 12 form a fluid flow path between the first reactor means and the second reactor means.

A source 14 of molecular hydrogen is connected to the first conduit means 8 by a third conduit means 16 which forms a fluid flow path between the source of molecular hydrogen and the first conduit means and to the second conduit means 12 by a fourth conduit means 18 which forms a fluid flow path between the source of molecular hydrogen and the second conduit means 12. Hydrocarbon liquid is withdrawn from the second reactor means by a fifth conduit means 20. (72)

Splitting the hydrogen into multiple streams permits use of a single recycle hydrogen compressor for the initial hydrotreating cleanup stage(s) and the subsequent noble metal catalyst hydroprocessing stage(s) of all the trains. One hydrogen stream is passed to the first hydrotreating clean up reactor and a second hydrogen stream is passed to the second dewaxing reactor. If it is a multiple train unit, the first and second hydrogen streams would again be split; either before or after the heater, with each half of the first hydrogen stream going to a hydrotreating reactor on one train and each half of the second hydrogen stream going to a dewaxing reactor on one train.

In the illustrated embodiment, the source of molecular hydrogen comprises a compressor 22 having an inlet 24 and an outlet 26. A sixth conduit means 28 connects the outlet of the compressor with an inlet 30 of the third conduit means 16 and an inlet 32 of the fourth conduit means 18.

The second conduit means 12 preferably includes a stripper means 34 for stripping dissolved gases from a liquid hydrocarbon. A stripping gas source 36 is connected to the stripper means to strip dissolved gases from liquid hydrocarbon flowing through the stripper means. A seventh conduit means 38 connects the first reactor means 6 with the stripper means. An a eighth conduit means 40 connects the stripper means with the second reactor means 10. The fourth conduit means 18 preferably forms a fluid flow path between the sixth conduit means 28 and the eighth conduit means 40.

The stripping gas source 36 preferably comprises a source of molecular hydrogen. The stripper preferably operates at a pressure only slightly less than the HT1. Most preferably, recycle hydrogen is used to strip $H_2S$ and $NH_3$ out of the hydrotreated oil. The hydrotreated oil containing essentially no sulfur or nitrogen is sent to the dewaxing reactor;

The stripper means 34 has an upper end and a lower end with an outlet 42 for stripped gases adjacent to the upper end. A ninth conduit means 44 forms a fluid flow path between the outlet 42 for stripped gases adjacent to the upper end of the stripper means and the inlet 24 of the compressor 22. The ninth conduit means 44 preferably comprises means 46 for removing nitrogen-containing gases and sulfur-containing gases from stripped gases flowing through the ninth conduit means 44. The means 46 for removing nitrogen-containing gases and sulfur-containing gases preferably comprises a means 48 for removing ammonia and a means 50 for removing hydrogen sulfide.

The means 48 for removing ammonia preferably comprises a wash unit for washing the stripped gases flowing through the ninth conduit means with water. The means 50 for removing hydrogen sulfide comprises an amine scrubber unit for scrubbing the stripped gases flowing through the ninth conduit means with an amine solution. The wash unit 52 is preferably positioned between the stripper 34 and the scrubber 50. The ninth conduit means further preferably comprises a liquid knockout unit 56 positioned between the scrubber and the inlet 24 to the compressor 22 for removing liquids from the stripped gases.

The third conduit means 16 preferably comprises a first means 58 for controlling flow through the third conduit means 16. The fourth conduit means 18 preferably comprises a second means 60 for controlling the flow through the fourth conduit means 18. The first and second means for controlling flow preferably comprise flow controllers. By use of the flow controllers, the hydrogen is split into multiple streams with control valves.

To provide for flow, the ninth conduit means preferably further comprises a third means 62 for controlling flow positioned between the stripper 34 and the wash unit 48. The third means 62 for controlling flow preferably comprises a differential pressure flow controller.

The fifth conduit means 20 preferably comprises a separator means 64 for separating a primarily molecular hydrogen containing stream from a liquid hydrocarbon. A tenth conduit means 66 forms a fluid flow path between the second reactor means 10 and the separator means 64. An eleventh conduit means 68 for forms a fluid flow path between an upper portion of the separator means 64 and the ninth conduit means 44. The eleventh conduit means preferably forms a fluid flow path to the ninth conduit means between the stripper means 34 and the means 46 for removing nitrogen-containing gases and sulfur-containing gases.

This structure permits the combining of the hydrogen stripper and hot separator overhead vapor streams. This stream is preferably cooled by means not shown and hydrocarbon liquids removed. The cold separator overhead is routed through a single recycle gas scrubber back to the common recycle compressor.

The tenth conduit means 66 preferably comprises a third reactor means 70 for hydrotreating a liquid hydrocarbon. The third reactor means preferably corresponds to the HT3 unit. A twelfth conduit means 72 forms a fluid flow path between the second reactor means 10 and the third reactor means 70. A thirteenth conduit means 74 forms a fluid flow path between the third reactor means 70 and the separator means 64.

This structure permits the dewaxing reactor effluent to be routed to an optional stabilization reactor to reduce aromatics of the lube base oil and eliminate any color or color bodies which may be present. The stabilization reactor outlet is connected to a hot separator. The hot separator bottoms are passed to a product stripping and fractionation section.

A heater means 76 is preferably positioned to heat molecular hydrogen flowing through the third conduit means 16 and the fourth conduit 18 means to a first temperature. The heater provides means to heat up the combined recycle hydrogen in hydrogen/reactor effluent exchangers from either or both the initial hydrotreating cleanup stage and the subsequent noble metal catalyst hydroprocessing stage. Preferably, the hydrogen heater is provided with an even number of passes. Each of these hydrogen streams is sent to its own pass or passes of the hydrogen heater (i.e.—train 1 hydrogen to pass 1 of a two pass heater or passes 1 and 2 of a four pass heater; train 2 hydrogen to pass 2 of a two pass heater or passes 3 and 4 of a four pass heater). Preferably, there is provided limited or no ability to separately control the hydrogen temperature leaving each side of the heater. While some control would always be possible by selectively turning off burners on one side of the heater, only a single fuel controller would be needed. The fuel could be controlled by the outlet temperature on either side of the heater. The operator could at any point control the entire heater basis, the heater outlet temperature on either the hydrotreating or the dewaxing side. Optionally, a brick wall could be provided in the middle of the radiant section to divide the heater into two radiant cells with a common convection section. This would, at minimal cost, permit separate fuel controllers to be used on each side of the heater and provide some degree of control of the hydrogen temperature to each train. However, it would still involve use of only a single heater to support both trains. Control the firing of the hydrogen heater basis whichever reactor (hydrotreating or dewaxing) requires more heat input. This would normally result in one of the reactors receiving more heat input than required.

Temperature is controlled in the illustrated system by providing cold quench hydrogen, such as directly from the recycle compressor to the inlet of the hydrotreating, the dewaxing, and the aromatics saturation reactors. In the illustration, apparatus for carrying out the provision of quench comprises a source 78 of molecular hydrogen at a second temperature which is less than the first temperature and a fourteenth conduit means 80 connecting the source 78 of molecular hydrogen at the second temperature with the third conduit means; a source 82 of molecular hydrogen at a second temperature which is less than the first temperature and a fifteenth conduit means 84 connecting the source 82 of molecular hydrogen at the second temperature with the fourth conduit means; and a source 86 of molecular hydrogen at a second temperature which is less than the first temperature; and a sixteenth conduit means 88 connecting the source 86 of molecular hydrogen at the second temperature with the thirteenth conduit means.

It is preferred to occasionally reduce the flow of hydrogen through the heater to the reactor which is receiving more heat than required and making up this flow with cold quench hydrogen. While reducing the flow through the heater will tend to increase the temperature of the hydrogen flowing through it, it will reduce the heat absorbed. Alternatively, the flow of hydrogen through the heater could be maintained constant while additional quench hydrogen is added at the reactor inlet thus resulting in more hydrogen than required being sent to the reactor. Additional hydrogen will always help the hydroprocessing reactions but may sometimes be impractical due to the increase in pressure drop it would cause.

In a further preferred embodiment of the invention, a heat exchange means 90 is positioned to heat fluid flowing through the first conduit means 8 and cool fluid flowing through the second conduit means 12 by indirect heat exchange therebetween. The hydrotreating reactor inlet would thus preferably be a mixture of oil from feed/effluent exchangers, hot hydrogen from the hydrogen heater and cold hydrogen directly from the recycle compressor. Charge oil goes to the hydrotreater reactor through hydrotreater feed/effluent exchangers.

In a further preferred embodiment of the invention, a heat exchange means 92 is positioned to heat fluid flowing through the second conduit means 12 and cool fluid flowing through fifth conduit means 20 by indirect heat exchange therebetween. The dewaxing reactor inlet is thus preferably a mixture of oil from feed/effluent exchangers, hot hydrogen from the hydrogen heater and cold hydrogen directly from the recycle compressor. Hydrotreated oil goes to the dewaxing reactor through dewaxing feed/effluent exchangers.

In a still further preferred embodiment of the invention, a heat exchange means 94 is positioned to heat fluid flowing though the eighth conduit means 40 and cool fluid flowing through the thirteenth conduit means 74 by indirect heat exchange therebetween. The stabilizing or saturation reactor inlet is thus preferably a mixture of oil and hydrogen from the feed/effluent exchangers and cold hydrogen directly from the recycle compressor.

Preferably, bypasses are provided on the feed sides of these exchangers. Temperature control is provided by bypassing some oil around the feed/effluent exchangers of the reactor that had more heat than required to control its inlet temperature.

Process

In the process of one embodiment of the invention, a lube oil stock is hydrotreated over a non-noble metal containing hydrotreating catalyst in an HDN/HDS unit to remove sulfur and nitrogen from the lube oil stock and produce an HDN/HDS unit effluent. The effluent comprises hydrodesulfurized, hydrodenitrogenated lube oil stock, hydrogen sulfide and ammonia. The hydrogen sulfide and ammonia are stripped from the hydrodesulfurized, hydrodenitrogenated lube oil stock to form a liquid stream comprising stripped lube oil stock and a first gas stream comprising hydrogen sulfide, ammonia and molecular hydrogen. The stripped lube oil stock is hydrotreated over a noble-metal containing hydrotreating catalyst in an HDW unit to produce an HDW unit effluent comprising a dewaxed lube oil stock. A second gas stream comprising molecular hydrogen is separated from the dewaxed lube oil stock. The first gas stream is combined with the second gas stream to form a third gas stream. The third gas stream is treated to remove ammonia and hydrogen sulfide and form a fourth gas stream comprising primarily molecular hydrogen. The fourth gas stream is compressed to form a fifth gas stream. At least a portion of the fifth gas stream is mixed with the lube oil stock.

In a preferred embodiment, the fifth gas stream is split into a sixth gas stream and a seventh gas stream. A least a portion of the sixth gas stream is mixed with the lube oil stock. At least a portion of the seventh gas stream is mixed with the stripped lube oil stock.

In a particularly preferred embodiment, the fifth gas stream and the sixth gas stream are heated in a heater to form a heated fifth gas stream and a heated sixth gas stream and these streams are mixed with the respective stocks.

Preferably, the stripping is carried out with molecular hydrogen at a temperature and pressure which is near that of the HDN/HDS unit.

The hydrotreating and stripping of the lube oil stock is preferably carried out to result in a concentration of sulfur in the stripped lube oil stock of less than about 200 wppm sulfur a nitrogen concentration of less than about 3 wppm nitrogen. The third gas stream is preferably treated so that the fourth gas stream contains less than about 20 vppm H2S and less than about 2 vppm NH3.

If desired, the dewaxed lube oil stock is hydrotreated over a noble-metal containing hydrotreating catalyst in an HDA unit to produce an HDA unit effluent comprising a dearomatized dewaxed lube oil stock, and the second gas stream comprising molecular hydrogen is separated from the dearomatized dewaxed lube oil stock.

In one aspect of the invention, an eighth gas stream is split from the fifth gas stream. A first portion of the eighth gas stream is mixed with the lube oil stock. A second portion of the eighth gas stream is mixed with the stripped lube oil stock.

In another aspect of the invention, heat is transferred from the HDN/HDS unit effluent to the lube oil stock in a heat exchanger as well as from the HDW unit effluent to the stripped lube oil stock in a heat exchanger.

EXAMPLE

A 16,000 bpd lube catalytic dewaxing unit has been designed to charge refined waxy distillates. The design charge stocks are an RWD-20 with a 110° F. pour point and 14.3 wt % wax and an RWD-8 with an 89° F. pour point and 15.6 wt % wax. The unit will have between an 80 and 90 wt % yield of lube base oils with a 10° F. pour point.

The unit will have a single hydrogen heater. The heater will provide the required amount of heat to the hydrogen going to the initial hydrotreating and downstream dewaxing and aromatic saturation reactors which use noble metal catalyst. The heater is sized for 54.0 MMBtu/hr (27.0 MMBtu/hr for each reactor). The hydrotreating reactor will produce a dewaxing reactor feed with 20–200 wppm sulfur and <3 wppm nitrogen. To achieve the low levels of nitrogen and sulfur, the material from the initial hydrotreating reactor exchanges heat and then hydrogen, light hydrocarbons, $H_2S$ and $NH_3$ are separated in a high temperature and pressure hydrogen stripper. In addition to the typical flash separation of recycle hydrogen and light hydrocarbons, essentially all the $H_2S$ and $NH_3$ is stripped from the liquid in a stripping section of that vessel. This operation eliminates the need to reduce pressure and steam strip the liquid product from the hydrotreater, and then pump it back up to hydroprocessing conditions. The hydrogen stripper and recycle gas scrubbers will ensure that the hydrogen to the noble metal catalyst in the dewaxing reactor has a maximum of 20 vppm $H_2S$ and 2 vppm $NH_3$.

What is claimed is:

1. A process comprising hydrotreating a lube oil stock over a non-noble metal containing hydrotreating catalyst in an HDN/HDS unit to remove sulfur and nitrogen from the lube oil stock and produce an HDN/HDS unit effluent comprising hydrodesulfurized, hydrodenitrogenated lube oil stock, hydrogen sulfide and ammonia;

stripping the hydrogen sulfide and ammonia from the hydrodesulfurized, hydrodenitrogenated lube oil stock to form a liquid stream comprising stripped lube oil stock and a first gas stream comprising hydrogen sulfide, ammonia and molecular hydrogen;

hydrodewaxing the stripped lube oil stock over a noble-metal containing dewaxing catalyst in an HDW unit to produce an HDW unit effluent comprising a dewaxed lube oil stock;

separating a second gas stream comprising molecular hydrogen from the dewaxed lube oil stock;

combining the first gas stream with the second gas stream to form a third gas stream;

treating the third gas stream to remove ammonia and hydrogen sulfide and form a fourth gas stream comprising primarily molecular hydrogen;

compressing the fourth gas stream to form a fifth gas stream; and mixing at least a portion of the fifth gas stream with the lube oil stock.

2. A process as in claim 1 further comprising splitting the fifth gas stream into a sixth gas stream and a seventh gas-stream;

mixing at least a portion of the sixth gas stream with the lube oil stock; and mixing at least a portion of the seventh gas stream with the stripped lube oil stock.

3. A process as in claim 2 further comprising splitting an eighth gas stream from the fifth gas stream, and mixing a first portion of the eighth gas stream with the lube oil stock; and mixing a second portion of the eighth gas stream with the stripped lube oil stock.

4. A process as in claim 2 further comprising transferring heat from the HDN/HDS unit effluent to the lube oil stock in a heat exchanger.

5. A process as in claim 2 further comprising transferring heat from the HDW unit effluent to the stripped lube oil stock in a heat exchanger.

6. A process as in claim 2 further comprising heating the fifth gas stream and the sixth gas stream in a heater to form a heated fifth gas stream and a heated sixth gas stream.

7. A process as in claim 1 wherein the stripping is carried out with molecular hydrogen at a temperature and pressure which is near that of the HDN/HDS unit.

8. A process as in claim 7 wherein the hydrotreating and stripping of the lube oil stock is carried out to result in a concentration of sulfur in the stripped lube oil stock of less than about 200 wppm sulfur a nitrogen concentration of less than about 3 wppm nitrogen.

9. A process as in claim 8 wherein the third gas stream is treated so that the fourth gas stream contains less than about 20 vppm H2S and less than about 2 vppm NH3.

10. A process as in claim 1 further comprising hydrotreating the dewaxed lube oil stock over a noble-metal containing hydrotreating catalyst in an HDA unit to produce an HDA unit effluent comprising a dearomatized dewaxed lube oil stock.

11. A process as in claim 10 wherein the second gas stream comprising molecular hydrogen is separated from the dearomatized dewaxed lube oil stock.

* * * * *